US006895957B2

(12) United States Patent
Yeung

(10) Patent No.: US 6,895,957 B2
(45) Date of Patent: May 24, 2005

(54) RANGE HOOD CLEANING ASSEMBLY

(76) Inventor: Peter Yeung, 4446 Frances Street, Burnaby (CA) V5C 2R4

( * ) Notice: Subject to any disclaimer, the term of this patent is extended or adjusted under 35 U.S.C. 154(b) by 0 days.

(21) Appl. No.: 10/625,742

(22) Filed: Jul. 24, 2003

(65) Prior Publication Data

US 2005/0016523 A1 Jan. 27, 2005

(51) Int. Cl.[7] ..... F24C 15/20
(52) U.S. Cl. ..... 126/299 E; 126/299 D; 134/167 C; 55/DIG. 36
(58) Field of Search ..... 126/299 R, 299 D, 126/299 E; 134/167 C; 55/DIG. 36; 96/326–328, 96/322; 454/54, 67

(56) References Cited

U.S. PATENT DOCUMENTS

| | | | | |
|---|---|---|---|---|
| 3,563,005 A | * | 2/1971 | Jones | 96/239 |
| 3,795,181 A | | 3/1974 | Lawson | |
| 4,085,735 A | | 4/1978 | Kaufman et al. | |
| 4,099,938 A | | 7/1978 | Onnen | |
| 4,259,945 A | | 4/1981 | Lawson | |
| 4,351,652 A | * | 9/1982 | Wisting | 96/265 |
| 5,027,790 A | | 7/1991 | Chern | |
| 5,235,963 A | | 8/1993 | Strause | |
| 5,359,990 A | | 11/1994 | Hsu | |
| 5,472,342 A | | 12/1995 | Welsh, II et al. | |
| 5,662,097 A | | 9/1997 | Panos | |
| 5,874,292 A | | 2/1999 | McMinn, Jr. | |
| 6,274,375 B1 | | 8/2001 | McMinn, Jr. | |
| 6,712,068 B1 | * | 3/2004 | Yeung | 126/299 E |

FOREIGN PATENT DOCUMENTS

| | | | |
|---|---|---|---|
| GB | 2 138 126 A | | 10/1984 |
| JP | 60-122846 | * | 7/1985 |

* cited by examiner

*Primary Examiner*—James C. Yeung
(74) *Attorney, Agent, or Firm*—Paul Smith Intellectual Property Law; Paul Smith; C. Larry Kyle

(57) ABSTRACT

A range hood cleaning assembly having a primary reservoir in fluid communication with a range hood motor housing. Wash fluid from the primary reservoir may be dispersed against grease laden surfaces of the fan and motor housing where it drains back to the primary reservoir, optionally via a secondary reservoir. Grease washed by the fluid floats to the top of an outlet chamber in the primary reservoir and out a drainage hole to an external receptacle. Alternatively, the grease may drain from the top of the secondary reservoir to the external receptacle. The primary and secondary reservoirs are shaped and sized to fit below the motor housing.

19 Claims, 6 Drawing Sheets

RANGE HOOD CLEANING ASSEMBLY

FIELD OF THE INVENTION

The present invention relates to range hood cleaning assemblies, and more particularly to a cleaning assembly for a range hood wherein cleaning solution used to remove grease from the fans and interior of a motor housing is recycled for reuse.

BACKGROUND OF THE INVENTION

Range hoods are used above cooking surfaces to remove grease, common odors and hazardous gases created during the cooking process. Typically, range hoods have a pair of motors horizontally installed in a motor housing within the hood body. Each motor drives a fan. The fans draw air from the cooking area below and force it through the motor housing to ventilation piping.

As the vaporized grease contained in the entrained air travels through the motor housing, some of it condenses on the inside walls of the housing. It is known in the art to provide a washing fluid under pressure in order to clean the interior of the exhaust system. For example, U.S. Pat. No. 4,259,945 teaches an exhaust system in which a washing fluid under pressure is used to clean the flue and fan. Further washing fluid systems are taught in U.S. Pat. Nos. 3,795,181 and 4,085,735.

While use of a washing fluid obviates the need to manually clean the interior of the range hood, it does provide its own set of difficulties, such as maintaining an adequate supply of washing fluid and the disposal of used washing fluid.

The '735 patent teaches a washing system that is connected to the city water supply so as to provide a constant supply of washing fluid. The grease and used washing fluid drains from a grease receptor to an appropriate grease collection facility. While this system provides a solution to obtaining a steady supply of washing fluid, hooking a range hood washing system to the city water supply is not always practical or possible. Furthermore, once the washing fluid is used it is considered waste and is disposed of.

It is also known in the art to place a refillable reservoir within the interior of the range hood so as to provide a supply of washing fluid. A fluid delivering nozzle is fitted into a hole in the side of the motor housing so as to deliver a spray of washing fluid to clean the interior of the housing. The washing fluid is delivered under pressure by a pump that is connected to the refillable reservoir of washing fluid. The reservoir may be filled through a coverable hole located in the range hood exterior. Once used, the washing fluid and any grease travelling therewith drains to an external grease receptacle.

While this refillable reservoir overcomes the problem of having to tap into a constant supply of washing fluid, due to its limited size it must be refilled often in order to ensure a constant supply of washing fluid. Furthermore, because all the used washing fluid and grease drains to the external receptacle, the receptacle must be emptied regularly in order to ensure it does not overflow, which would cause an unwanted mess.

Therefore, while these prior art systems reduce the amount of manual cleaning required of the range hood exhaust systems, they suffer from the deficiencies noted above. Furthermore, given that once used the washing fluid is disposed of as waste, the systems as a whole are wasteful. Society is increasingly aware of environmental concerns, particularly those associated with use of water. Given the increased consumer awareness of the benefits of conservation of our natural resources, an improvement to these wasteful systems is desired.

It is therefore an object of an embodiment of the present invention to provide a range hood having a cleaning assembly that reuses used washing fluid.

It is a further object of an embodiment of the present invention to provide a cleaning solution container for a range hood that is larger in size relative to the cleaning solution containers of the prior art.

Other objects of the invention will be apparent from the description that follows.

SUMMARY OF THE INVENTION

A cleaning assembly according to the preferred embodiment of the invention has individual components in fluid communication. A primary reservoir may be filled with liquid, preferably a washing fluid. At least one wash pump is connected to a wash outlet from the primary reservoir. The wash pump is in fluid communication with at least one fluid dispenser, preferably a nozzle, by way of a conduit or hose. When the wash pump is activated washing fluid is dispersed against selected surfaces of a motor housing and/or fan. The washing fluid rinses accumulated grease from the surfaces within the range hood. The motor housing acts as a receptacle, collecting the fluid dispensed from the fluid dispenser. The grease/washing fluid mixture drains from the interior of the motor housing eventually returning to the primary reservoir for reuse.

Preferably the motor housing drain is in fluid communication with a secondary reservoir. The secondary reservoir is in turn in fluid communication with the primary reservoir. A waste pump forces the grease/washing fluid mixture back into the primary reservoir. An overflow outlet in the primary reservoir is in fluid communication with an external grease receptacle. Grease from the motor housing interior adds to the volume of liquid in the primary reservoir. Because grease floats on water it rises to the surface. When the volume is sufficiently high, excess fluid travels out overflow outlet to the external receptacle. In this manner, grease is essentially skimmed from the wash fluid, allowing the wash fluid to be reused.

According to the present invention there is provided a cleaning assembly for a range hood wherein the assembly is mounted within the range hood and comprises a primary reservoir for holding fluid, a fluid dispenser in fluid communication with the primary reservoir and a receptacle for collecting fluid that has been dispensed from the fluid dispenser. The fluid dispenser is adapted to direct the fluid toward at least one surface within range hood. The receptacle is in fluid communication with the primary reservoir.

The present invention is also directed to the cleaning assembly defined above, wherein the primary reservoir includes a main chamber and a first chamber defined in relation to the main chamber, the first chamber being in fluid communication with the main chamber. The receptacle is in fluid communication with an inlet of the first chamber and the first chamber comprises an outlet for draining fluid from the first chamber.

In another aspect of the invention the outlet of the first chamber is at a higher elevation than the inlet of the first chamber.

In another aspect of the invention the primary reservoir further comprises a second chamber defined in relation to the main chamber, the second chamber being in fluid communication with the main chamber and an inlet opening in the second chamber, the inlet opening being at a higher elevation than the main chamber.

In another aspect of the invention the outlet of the first chamber is at a higher elevation than the inlet of the first chamber.

In yet another aspect of the invention first chamber is defined within the primary reservoir by a wall extending downward from a top wall of the main chamber and wherein the fluid communication between the first chamber and the main chamber is through a gap between a lowermost end of the wall and a bottom surface of the main chamber.

In another aspect of the invention the fluid communication between the receptacle and the primary reservoir is through a secondary reservoir, the assembly further comprising a pump for pumping fluid from the secondary reservoir to the primary reservoir.

In another aspect of the invention the fluid communication between the receptacle and the primary reservoir is through a secondary reservoir, the assembly further comprises a pump for pumping fluid from the secondary reservoir to the primary reservoir and the pump pumps fluid from the secondary reservoir to the primary reservoir through the inlet.

In another aspect of the invention the outlet of the first chamber drains to an external grease receptacle.

In another aspect of the invention the secondary reservoir includes a pump chamber and a drain chamber, the pump chamber being in fluid communication with the drain chamber.

In another aspect of the invention the outlet of the first chamber is in fluid communication with the secondary reservoir.

In another aspect of the invention the drain chamber is in fluid communication with an external grease receptacle.

In another aspect of the invention fluid draining from the outlet of the first chamber drains to the drain chamber of the secondary reservoir.

In another aspect of the invention the drain chamber is defined within the secondary reservoir by a wall extending down from a top surface of the pump chamber and wherein the fluid communication between the pump chamber and the drain chamber is through a gap between a lowermost end of the wall and a bottom surface of the pump chamber.

In another aspect of the invention the primary reservoir is mounted below and in abutment with the receptacle.

In another aspect of the invention the cleaning assembly further comprises a dispensing pump for pumping fluid from the primary reservoir to the dispenser.

Other aspects of the invention will be appreciated by reference to the detailed description of the preferred embodiment and to the claims that follow.

BRIEF DESCRIPTION OF THE DRAWINGS

These and other features of the invention will become more apparent from the following description in which reference is made to the appended drawings wherein.

DETAILED DESCRIPTION OF THE PREFERRED EMBODIMENT

Figure 1:
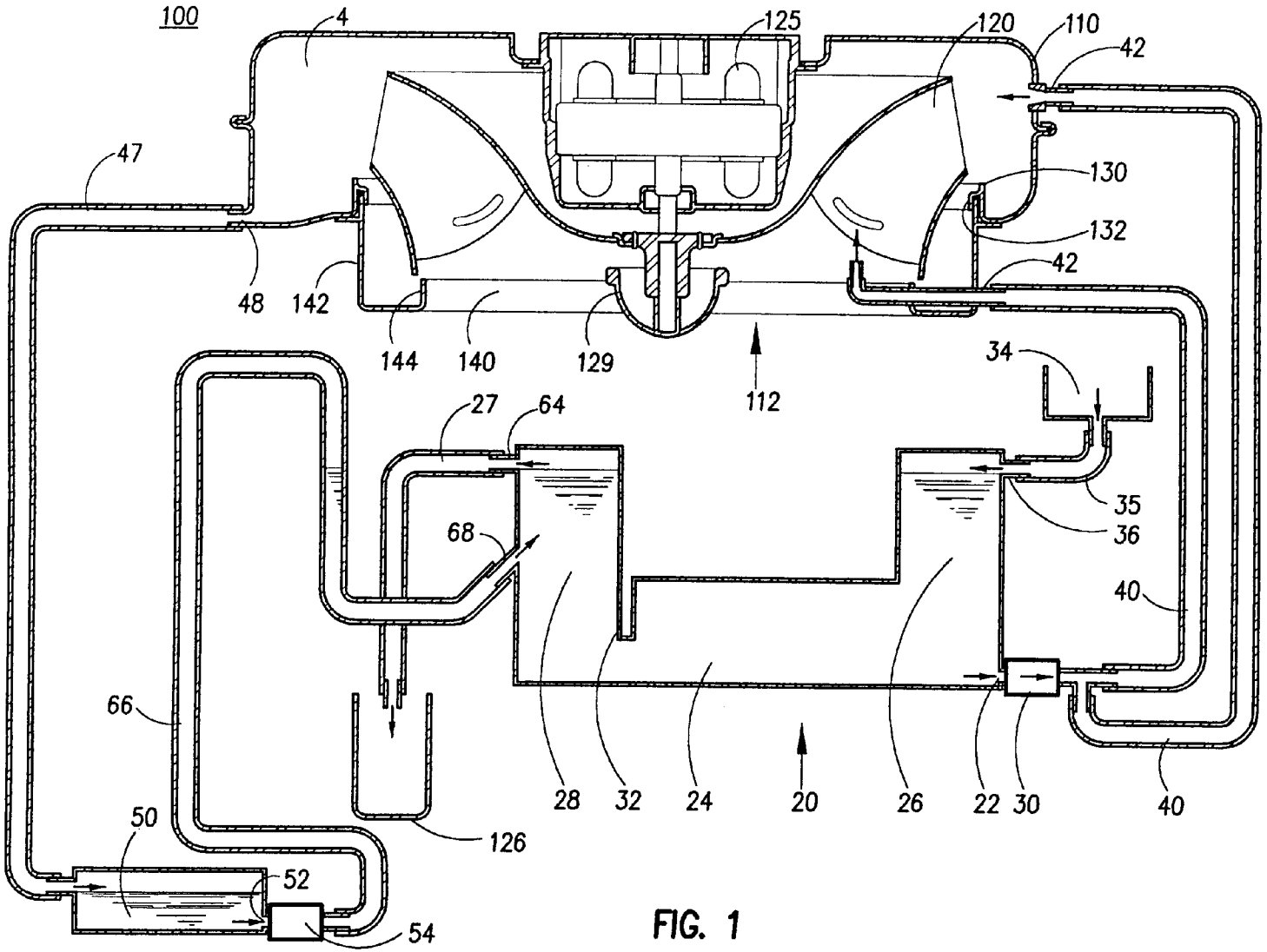
FIG. 1 is a diagrammatic view of a cleaning assembly according to the preferred embodiment of the invention.

The preferred embodiment of a cleaning assembly 100 is shown in FIG. 1. A primary reservoir 20 may be filled with liquid, preferably a washing fluid. At least one wash pump 30 is connected to an outlet 22 from the primary reservoir. Wash pump 30 is in fluid communication with at least one fluid dispenser, preferably a nozzle 42. Fluid communication is achieved by conduit 40. When the wash pump 30 is activated washing fluid is dispersed against selected surfaces of the motor housing 110 and fan 120. The washing fluid rinses accumulated grease from the surfaces within the range hood. The motor housing 110 acts as a receptacle, collecting the fluid dispensed from the fluid dispenser. The grease/washing fluid mixture drains from the interior of the motor housing 110 eventually returning to the primary reservoir 20 for reuse, as will be described in greater detail below.

Figure 4:
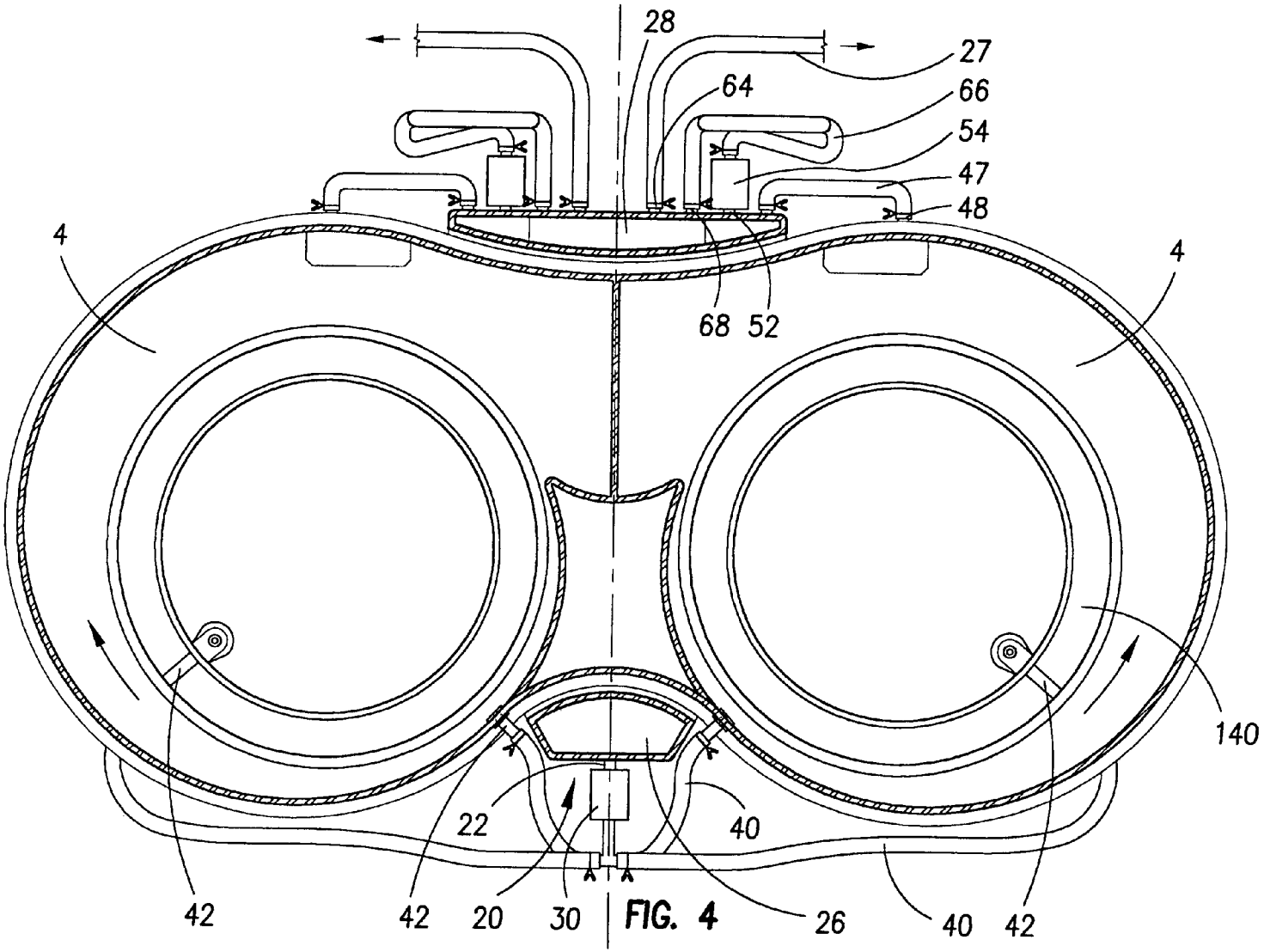
FIG. 4 is a sectional view through the top of the motor housing of the cleaning assembly shown in FIG. 2.

The motor housing 110 defines an enclosure and is mountable within a further enclosure formed by the range hood body (not shown). The interior of the housing 110 may be coated with a non-stick material so as to facilitate grease removal and is separated into two substantially similar, separate chambers 4, as shown in FIG. 4. Each chamber 4 has an intake opening 112 and ventilation hole (not shown).

A motor 125 is fitted in each chamber 4 of the motor housing 110 and is attached to the inside of the upper surface of the range hood body (not shown). A fan 120 is secured to each of the motors 125 by fan caps 129, and acts to draw grease-laden air into the motor housing 110 where it is forced out the ventilation holes.

The motor housing 110 acts as an integral grease catcher and includes walls 130 depending and rising vertically from the lower surface of the motor housing into each chamber 4. An outwardly and downwardly projecting extension or lip 132 depends from wall 130, so as to form a gap between the lip 132 and wall 130. Extension 132 may diverge from wall 130 such that the gap forms a wedge surface. A tray 140 is dimensioned such that its outer wall 142 may be releasably connected within gap 134. Inner wall 144 preferably has a diameter less than that of the lower edge of the fan 120.

Preferably, the motor housing 110 is of reduced height such that fan 120 extends down through the intake opening 112. The grease tray 140 is shaped so as to accommodate the fan extending out of the motor housing 110. This configuration increases the amount of space available between the trays 140 when they are attached to the motor housing and between the bottom of the motor housing 110 and the lower surface of the range hood. The motor housing 110 is shaped such that its lower surface slopes from front to back, thereby causing liquid within its interior to drain towards drainage holes 48 located at the lowest point of each chamber of the motor housing.

Figure 2:
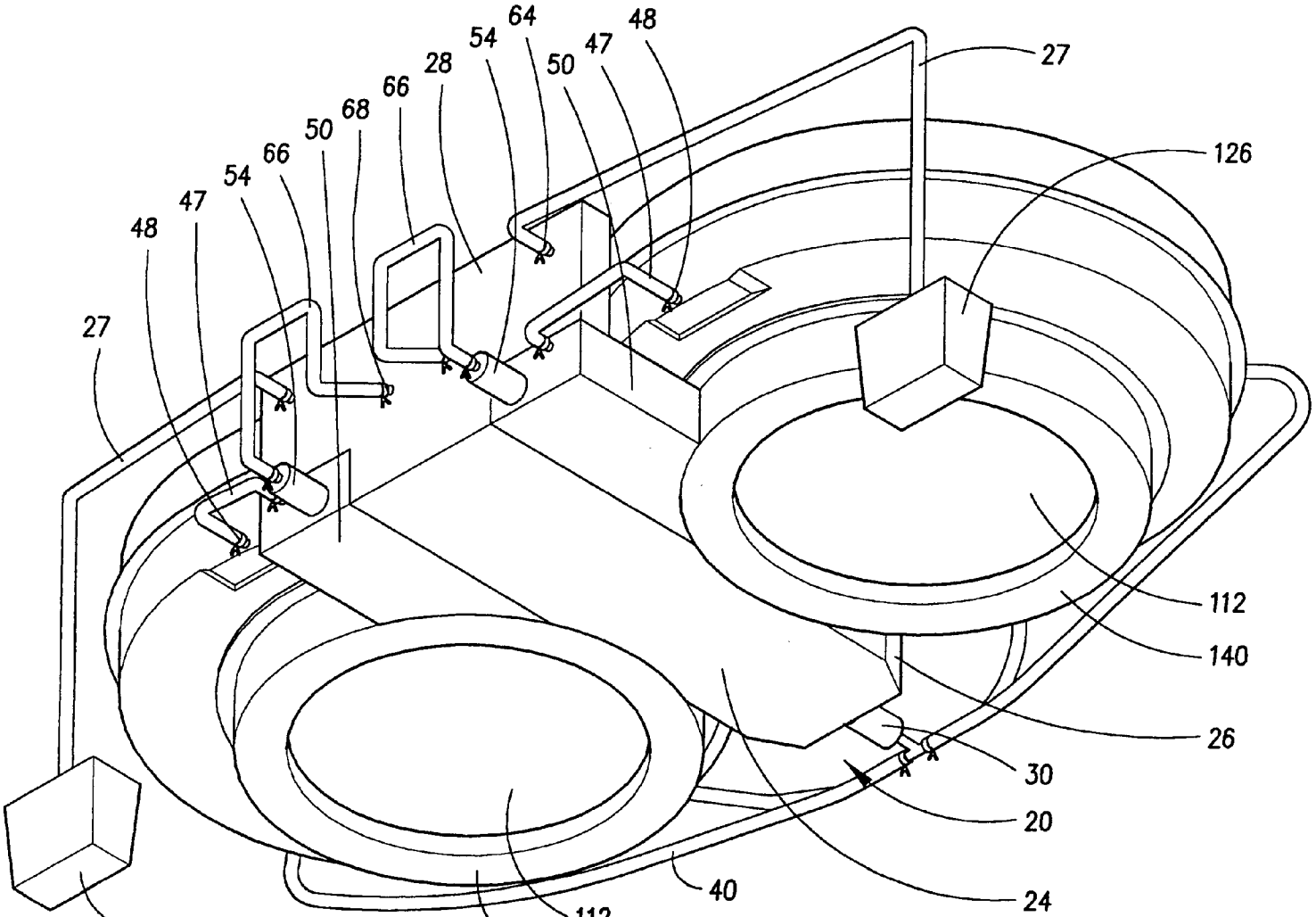
FIG. 2 is a perspective view from the bottom of the cleaning assembly shown in FIG. 1, with the fan and motor removed.
Figure 3:
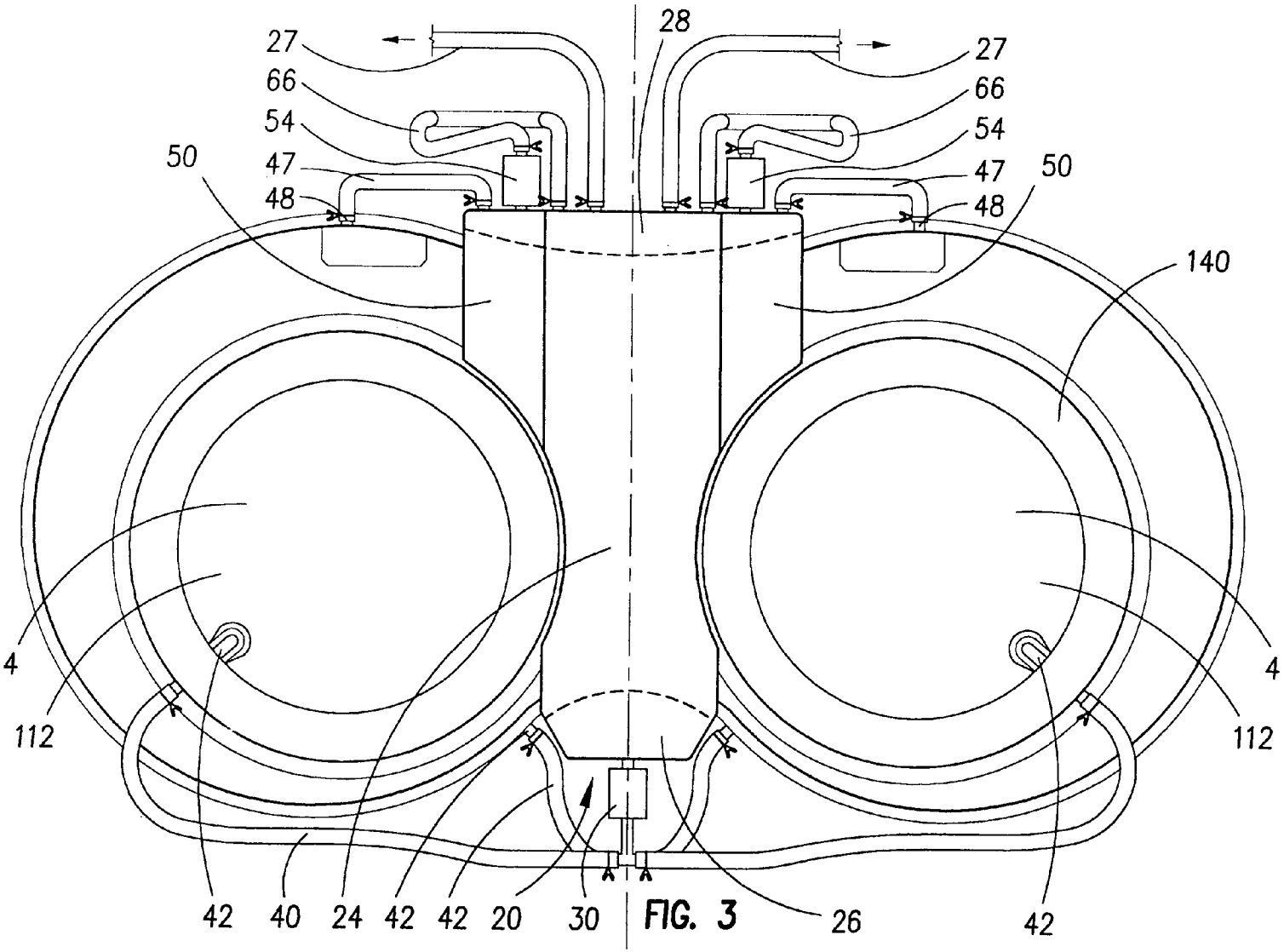
FIG. 3 is a plan view of the bottom of the cleaning assembly shown in FIG. 2.

Primary reservoir 20 has inlet chamber 26, main chamber 24 and overflow chamber 28. A barrier wall 32 extends down from the top of main chamber 24 partially separating main chamber 24 and overflow chamber 28. Fluid communication between overflow chamber 28 and main chamber 24 occurs through a gap between the lowermost end of barrier wall 32 and the bottom surface of the main chamber 28. Preferably, the primary reservoir 20 is shaped so that it fits below motor housing 110 between grease trays 140 as shown in FIGS. 2–4. The overflow chamber 28 of the primary reservoir 20 may be T-shaped as shown in FIG. 2, so as to make the best use of the space available to it. The conduits 40 are preferably comprised of a flexible hose.

In the preferred embodiment there is provided a secondary reservoir 50 for each chamber 4 of the motor housing 110. Preferably, secondary reservoirs 50 are located below the motor housing on either side of the primary reservoir 20 such that they are seated below the top of the "T" of the overflow chamber 28 and adjacent a grease tray 140, as best illustrated in FIGS. 2 and 3. Liquid from the motor housing 110 (grease and washing fluid) drains out drainage holes 48 to secondary reservoirs 50. A waste pump 54 is connected to each secondary reservoir 50. When it is activated, waste pump 54 pumps fluid from outlet 52 of the secondary reservoir 50 through hose 66 to inlet 68 and into the overflow chamber 28 of primary reservoir 20. Inlet 68 is set at an upward angle into overflow chamber 28 so that liquid being pumped into the overflow chamber flows in an upward direction. This ensures that grease travelling with the washing fluid does not migrate past barrier 32 to either main chamber 24 or inlet chamber 26. As shown in FIG. 2, hoses 66 have a mid-portion that extends to a greater height than inlet 68 (and therefore outlet 52, which is lower than inlet 68), so as to prevent liquid in the primary reservoir from draining into secondary reservoir 50.

Alternatively, a one-way valve could be used in order to prevent backflow into the secondary reservoirs 50.

Grease droplets are lighter than water and will float to the top of the overflow chamber 28 of the primary reservoir 20. When the liquid in the primary reservoir 20 reaches the overflow drain 64 located at the top of the overflow chamber 28, the liquid drains out. A drainage hose 27 carries liquid from overflow drain 64 to an external grease receptacle 126.

Operation of the cleaning assembly is best described by reference to the simplified diagrammatic view of FIG. 1. The container is filled by pouring cleaning solution in a fill hole 34 located in the upper surface of a range hood body. The solution travels through hose 35 into inlet chamber 26. Preferably when first priming the cleaning assembly, the primary reservoir 20 is filled to capacity and then the wash pump 30 is activated so as to fill the secondary reservoir (by way of liquid draining from the motor housing).

The cleaning assembly may be activated automatically or manually. The range hood may be pre-programmed so that the cleaning assembly is activated automatically after a specified amount of use. In addition, manual controls for both the wash pump 30 and waste pump 54 may be used to control the functioning of the assembly, both during initial priming, during re-filling and when additional cleaning is desired. In automatic use, both the wash pump 30 and waste pump 54 are activated at the same time. Therefore by initially filling the secondary reservoir, the primary reservoir 20 is being refilled in the overflow chamber 28 while it is being drained from the inlet chamber 26.

When the assembly is activated, the components of the assembly act in fluid communication with one another. Wash fluid is pumped under pressure by wash pump 30 through conduits 40 to the motor housing 110 where it is dispersed by nozzles 42 against grease laden surfaces of the range hood (the interior of the motor housing 110 and the fans 120). Fluid within each chamber of the motor housing 110 drains out its respective drainage hole 48 through hose 47 to secondary reservoir 50. At the same time, waste pump 54 pumps fluid from secondary reservoir 50 through hose 66 to inlet 68 where it enters overflow chamber 28 at an upward angle. Grease travelling with the used wash fluid floats up in the overflow chamber 28 and drains out drainage hole 64 through hose 27 to external receptacle 126, such that the grease is effectively skimmed from the surface of the wash fluid in the primary reservoir 20. Wash fluid returning to primary reservoir 20 can then be reused.

Figure 5:
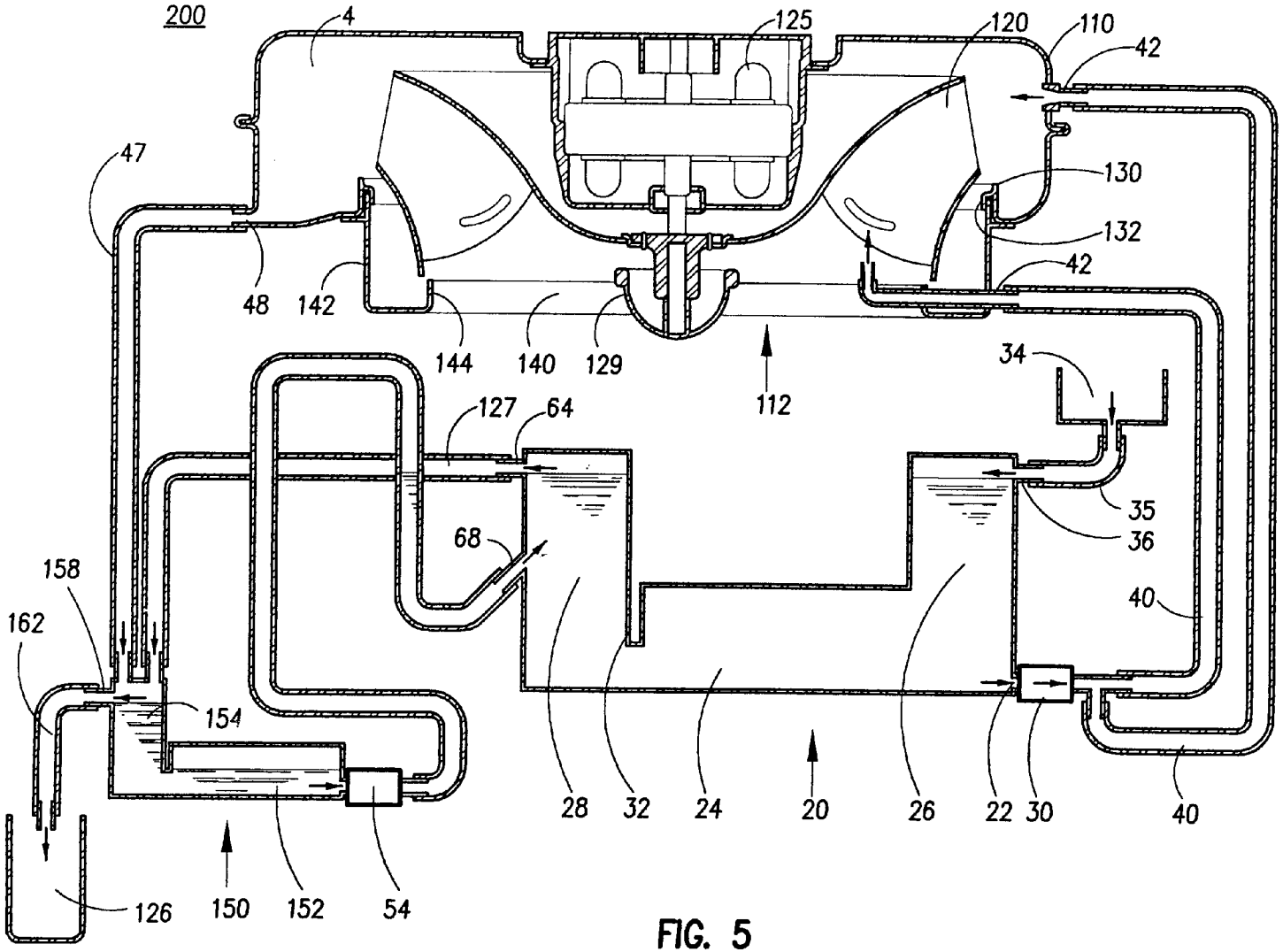
FIG. 5 is a diagrammatic view of an alternative embodiment of a cleaning assembly for a range hood.
Figure 6:
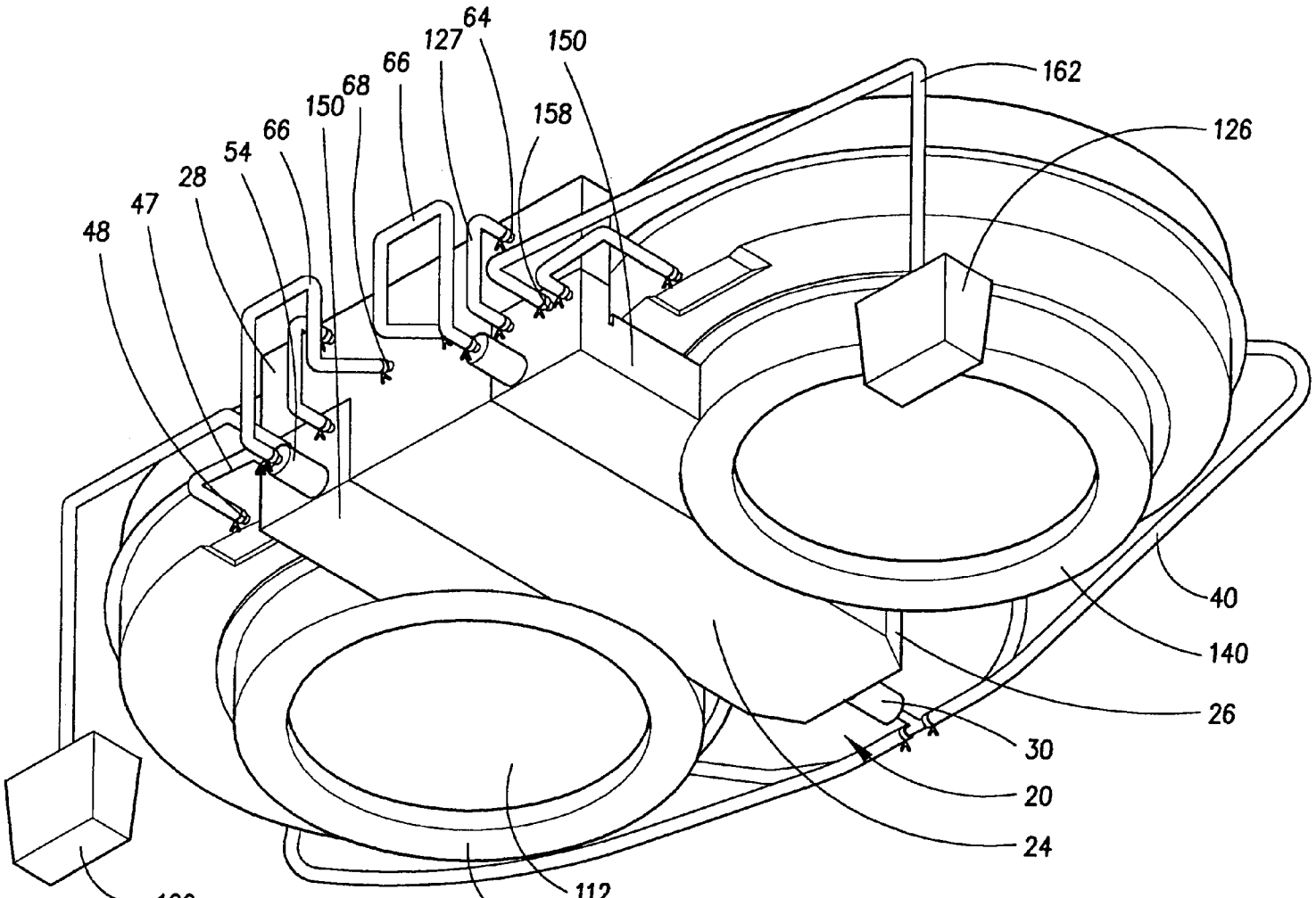
FIG. 6 is a perspective view from the bottom of the cleaning assembly shown in FIG. 5, with the fan and motor removed.

In an alternative embodiment of the invention illustrated in FIGS. 5 and 6, the cleaning assembly 200 has an additional overflow system in place. Components identical to those of the preferred embodiment have been identified with identical reference numbers. In this embodiment, secondary reservoirs 150 have a pump chamber 152 and a drain chamber 154 and wall 156 partially separating the two. Liquid spilling from overflow drain 64 of primary reservoir 20 travels by way of hose 127 to the drain chamber 154 of the secondary reservoir 150 rather than directly to external receptacle 126. Whenever the level of fluid in the secondary reservoir reaches a critical level it spills out drain hole 158 and travels through hose 162 to external receptacle 126.

Preferably, the primary and secondary reservoirs will be in contact with the motor housing 110. Heat from the motor housing will be conducted to the fluid within the reservoirs. Typically the combination of heat conducted from the motor housing and heat from the cooking surface below will be sufficient to raise the temperature of the wash fluid to a sufficient level that grease does not solidify therein. However, it is also contemplated that both the primary and secondary reservoirs could have heating elements to ensure that fluid contained therein is kept at a sufficient temperature to keep grease from solidifying.

The wash fluid is preferably a mixture of water and detergent. While it is anticipated that some of the washer fluid will be lost to evaporation, this will not be substantial. Accordingly, the primary reservoir 20 need be filled less often than the reservoirs of the prior art. Additionally, given its better use of space within the range hood, the primary reservoir 20, in conjunction with the additional fluid contained within the secondary reservoirs 50 has a much greater fluid capacity than the reservoirs of the prior art.

It will be appreciated by those skilled in the art that the preferred and alternative embodiments have been described in some detail but that certain modifications may be practiced without departing from the principles of the invention.

What is claimed is:

1. A cleaning assembly for a range hood, said assembly being mounted within said range hood and comprising:

a motor housing defining an enclosure having at least one intake opening, at least one fan and one motor being mounted within said motor housing enclosure in alignment with said at least one intake opening;

a primary reservoir for holding fluid having first and second inlets and first and second outlets, said primary reservoir being located externally to said motor housing enclosure and being fillable with fluid through said first inlet;

a fluid dispenser in fluid communication with said primary reservoir, said fluid dispenser being adapted to direct said fluid into said motor housing enclosure;

a conduit for transporting fluid from within said motor housing enclosure to said primary reservoir via said second inlet.

2. The cleaning assembly of claim 1 wherein said primary reservoir is mounted below and in abutment with said motor housing.

3. The cleaning assembly of claim 1 further comprising a dispensing pump for pumping fluid from said primary reservoir to said dispenser.

4. The cleaning assembly of claim 1 wherein said conduit comprising a secondary reservoir, said assembly further comprising a pump for pumping fluid from said secondary reservoir to said reservoir.

5. The cleaning assembly of claim 4 wherein said fluid dispense draws fluid through said first outlet, said second outlet being in fluid communication with an external grease receptacle.

6. The cleaning assembly of claim 4 wherein said fluid dispenser draws fluid through said first outlet, said second outlet being in fluid communication with said secondary reservoir.

7. A cleaning assembly for a range hood, said assembly being mounted within said range hood and comprising:

a primary reservoir for holding fluid, said primary reservoir including a main chamber and a first chamber defined in relation to said main chamber, said first chamber being in fluid communication with said main chamber and comprising an outlet for draining fluid from said first chamber;

a fluid dispenser in fluid communication with said primary reservoir, said fluid dispenser being adapted to direct said fluid toward at least one surface within said range hood;

a receptacle for collecting fluid that has been dispensed from said fluid dispenser said receptacle being in fluid communication with said primary reservoir and with an inlet of said first chamber.

8. The cleaning assembly of claim 7 wherein said outlet of said first chamber is at a higher elevation than said inlet of said first chamber.

9. The cleaning assembly of claim 8 wherein:

said fluid communication between said receptacle and said reservoir is through a secondary reservoir;

said assembly further comprising a pump for pumping fluid from said secondary reservoir to said primary reservoir; and, said pump pumps fluid from said secondary reservoir to said reservoir through said inlet.

10. The cleaning assembly of claim 9 wherein fluid draining from said outlet of said first chamber drains to an external grease receptacle.

11. The cleaning assembly of claim 9 wherein said secondary reservoir includes a pump chamber and a drain chamber, said pump chamber being in fluid communication with said drain chamber.

12. The cleaning assembly of claim 11 wherein said outlet of said first chamber is in fluid communication with said secondary reservoir.

13. The cleaning assembly of claim 12 wherein said drain chamber is in fluid communication with an external grease receptacle.

14. The cleaning assembly of claim 11 wherein fluid draining from said outlet of said first chamber drains to said drain chamber of said secondary reservoir.

15. The cleaning assembly of claim 11 wherein said drain chamber is defined within said secondary reservoir by a wall extending down from a top surface of said pump chamber and wherein said fluid communication between said pump chamber and said drain chamber is through a gap between a lowermost end of said wall and a bottom surface of said pump chamber.

16. The cleaning assembly of claim 7 wherein:

said primary reservoir further comprises a second chamber defined in relation to said main chamber, said second chamber being in fluid communication with said main chamber; and, an inlet opening in said second chamber, said inlet opening being at a higher elevation than said main chamber.

17. The cleaning assembly of claim 16 wherein said outlet of said first chamber is at a higher elevation than said inlet of said first chamber.

18. The cleaning assembly of claim 7 wherein said first chamber is defined within said primary reservoir by a wall extending downward from a top wall of said main chamber and wherein said fluid communication between said first chamber and said main chamber is through a gap between a lowermost end of said wall and a bottom surface of said main chamber.

19. The cleaning assembly of claim 7 wherein said fluid communication between said receptacle and said primary reservoir is through a secondary reservoir, said assembly further comprising a pump for pumping fluid from said secondary reservoir to said primary reservoir.

* * * * *

UNITED STATES PATENT AND TRADEMARK OFFICE

CERTIFICATE OF CORRECTION

PATENT NO. : 6,895,957 B2
DATED : May 24, 2005
INVENTOR(S) : Yeung

It is certified that error appears in the above-identified patent and that said Letters Patent is hereby corrected as shown below:

Column 7,
Line 4, replace "reservoir to said reservoir" with -- reservoir to said primary reservoir --
Line 34, replace "said reservoir is" with -- said primary reservoir is --
Line 39, replace "said reservoir through" with -- said primary reservoir through --

Signed and Sealed this

Twelfth Day of July, 2005

JON W. DUDAS
*Director of the United States Patent and Trademark Office*